US005990608A

United States Patent [19]

Shiroishi

[11] Patent Number: 5,990,608

[45] Date of Patent: Nov. 23, 1999

[54] ELECTRON GUN HAVING A CATHODE WITH LIMITED ELECTRON DISCHARGE REGION

[75] Inventor: Tetsuya Shiroishi, Tokyo, Japan

[73] Assignee: Mitsubishi Denki Kabushiki Kaisha, Tokyo, Japan

[21] Appl. No.: 08/975,248

[22] Filed: Nov. 21, 1997

[30] Foreign Application Priority Data

Feb. 7, 1997 [JP] Japan ..... 9-025208
Sep. 29, 1997 [JP] Japan ..... 9-263691

[51] Int. Cl.[6] ..... H01J 29/04; H01J 29/48; H01J 1/28

[52] U.S. Cl. ..... 313/412; 313/447; 313/449; 313/452; 313/453

[58] Field of Search ..... 313/112, 446, 313/447, 449, 452, 453, 346 R, 346 DC

[56] References Cited

U.S. PATENT DOCUMENTS 2,718,607 9/1955 Katz ..... 313/346 DC
2,895,070 7/1959 Espersen ..... 313/346 R
3,534,455 10/1970 Bondley ..... 313/346 R
3,980,919 9/1976 Bates et al. ..... 313/453

FOREIGN PATENT DOCUMENTS 5-198250 8/1993 Japan .
7-85807 3/1995 Japan .

*Primary Examiner*—Ashok Patel
*Attorney, Agent, or Firm*—Sughrue, Mion, Zinn, Macpeak & Seas, PLLC

[57] ABSTRACT

An electron gun provides an improved focusing characteristic of electron beams surely and effectively, and permits position alignment to be relatively easy in assembling thereof. In an electron gun which includes a cathode for discharging electrons and a plurality of grids each having electron passing-through holes for guiding the electrons discharged from the cathode unidirectionally, an electron dischargeable region is formed in an electron discharging plane of the cathode, which is band-shaped. In addition, the length of the band-shaped area constituting the electron dischargeable region on its shorter side is less than 80% of the diameter of the area from where electrons are discharged when a practical maximum current is taken out without limiting the electron dischargeable region.

6 Claims, 15 Drawing Sheets

ELECTRON GUN HAVING A CATHODE WITH LIMITED ELECTRON DISCHARGE REGION

BACKGROUND OF THE INVENTION

The present invention relates to an electron gun for a cathode ray tube which is used for CRT, electron microscope or an electron beam exposure device, and more particularly to an improvement in a cathode of the electron gun.

FIG. 19 is an enlarged sectional view of the vicinity of a cathode of a conventional electron gun as disclosed in JP-A-7-85807. In FIG. 19, reference numeral 1 denotes a heater. Reference numeral 2 denotes a sleeve composed of an inner sleeve 2A of a cylinder of molybdenum formed so as to surround the heater 1 and an outer sleeve 2B covering the inner sleeve 2A. The upper side (discharging side of electrons) of the inner sleeve is blocked. The upper end of the outer sleeve 2B is also blocked like the inner sleeve 2A whereas its center is opened. Reference numeral 3 denotes an electron dischargeable (i.e., discharge) region, and reference numeral 4 denotes a cathode pellet.

The cathode used in the above conventional electron gun is called an impregnated cathode. The cathode pellet 4 is formed of a porous substrate of tungsten (W) impregnated with aluminate compound of BaO, CaO and $Al_2O$.

The cathode pellet 4 is fixed on the upper central surface of the blocking portion of the inner sleeve 2A and exposed from the opening portion of the outer sleeve 2B. This exposed area of the cathode pellet 4 constitutes an electron dischargeable region 3. The sleeve 2 and cathode pellet 4 constitutes a cathode 5.

Above and apart from the cathode 5, a first grid 6 is provided. The first grid 6 is provided with a first grid electron passing through-hole 7. Above the first grid 6, a second grid 8 is arranged, which is provided with a second grid electron passing through-hole 9. The first grid 6 and the second grid 8 are formed of a conductive plate.

FIG. 20 shows an entire schematic configuration of a cathode ray tube used in the conventional electron gun. In FIG. 20, reference numeral 10 is a fluorescent screen opposed to the cathode 5.

As seen from FIG. 20, on the side of the fluorescent screen 10, the third grid 11, fourth grid 12 and fifth grid 13 are provided. These third, fourth and fifth grids are formed of a conductive plate and provided with an electron passing through-hole, respectively.

It should be noted that the cathode 5 and the plural grids 6, 8, 11, 12 and 13 are secured by a supporting body (not shown) so that they are in a proper alignment with one another.

Further, the first grid electron passing through-hole 7 and second grid electron passing through-hole 9 are formed of cylindrical holes having equal diameters located on the same axis, respectively. On the extending line of the axis, the cathode pellet 4 is located. The cathode pellet 4 is formed in a region around the above axis, and has a smaller area than that of the first grid electron passing though-hole 7.

An explanation will be given of the electron gun having the above configuration. To the first grid 6, a predetermined voltage, lower than that applied to the cathode 5, is applied. To the second grid 8, a predetermined voltage, higher than that applied to the cathode 5, is applied. In this way, by applying suitable voltages to the cathode 5, first grid 6 and second grid 8, electrons can be taken out to side of the fluorescent screen 10. The amount of electrons to be taken out, i.e., discharging current, can be adjusted by varying the voltage at the cathode 5 or first grid 6. Also, to the third grid 11, fourth grid 12 and fifth grid 13, predetermined voltages are applied. Thus, the electrons discharged from the surface of the cathode 5 by the field lens composed of the cathode 5 and plural grids 6, 8, 11, 12 and 13 are incident on the fluorescent screen 10 in their focused state.

As described above, the main configuration of the electron gun is provided with the cathode 5 for discharging electrons and plural grids 6 and 8 provided with the electron passing though-holes 7 and 9 for unidirectionally guiding the electrons discharged from the cathode 5.

FIG. 21 is a view for explaining the locus of the electrons discharged from the cathode 5, which illustrates the electron locus in the neighborhood of the cathode on its section. In FIG. 21, the abscissa represents a distance (mm) from the electron discharging plane of the cathode 5 toward the electron discharging side, and the ordinate represents the distance (mm) from the center axis on the electron discharging plane. Reference numeral 14 denote electron loci of the electrons discharged from the cathode 5 and reference symbol D denotes an equi-potential line. As seen from FIG. 21, the electrons discharged from the neighborhood of the cathode 5 provide crossover points in the vicinity of the fluorescent screen (right side of FIG. 21), whereas the electrons discharged from positions remote from the central axis Z provide cross-over points in the neighborhood of the electron discharging plane (left side in FIG. 21). Specifically, the force acting on electrons is in the direction normal to the equi-potential line. The field lens including the cathode 5, first grid 6 and second grid 8 is regarded as a spherical lens. Therefore, the electron beams discharged from the neighborhood of the center axis Z of the electron discharging plane cross over substantially at a single point. On the other hand, the electrons discharged from the positions apart from the center axis Z are subjected to the strong force directed to the center axis so that they provide cross-over points at positions nearer to the electron discharging plane than the electrons discharged from the neighborhood of the center axis Z do.

For this reason, reducing the diameter of an electron dischargeable region can eliminate the electron discharging from the positions remote from the center axis Z so that occurrence of "halo" due to the electron discharge therefrom can be reduced. Thus, the converging characteristic can be improved. In this way, the electron gun having the above configuration, in which the electron dischargeable region 3 has a smaller area than that of the first grid electron passing through-hole 7, can improve the convergence characteristic of electrons.

The first problem of the above conventional electron gun is to require the coincidence of the respective center axes of the electron dischargeable region 3, first grid passing through-hole 6 and second grid electron passing through-hole 8, which makes adjustment of axis alignment difficult.

The second problem of the conventional electron gun is as follows. In the case where the area of the electron dischargeable region 3 is made excessively smaller than that of the first grid electron passing through-hole 7, the electron convergence characteristic is not necessary improved in a greater degree than in the electron gun in which the area of the electron dischargeable region 3 is larger than that of the first grid electron passing through-hole 7.

The second problem will be described below in more detail. Where the electron dischargeable region is so large that it does not limit the electron discharging region, the electron discharging region in the electron discharging plane is determined mainly by the discharging current amount although it varies according to the type of the electron gun. For example, the electron gun used for CRT has an upper limit of the discharging current amount in a practical use according to the use and performance of CRT.

The upper limit in practical use will be explained. For example, the CRT for display monitor generally requires the image luminance as high as about 100 cd/cm$^2$. In the case of a color monitor, electrons discharged from the electron discharging plane of the cathode are incident on the aperture grill provided with an electron passing slits or the shadow mask provided with electron passing through-holes according to the luminescent pattern of the luminescent screen. The electrons having passed through the electron passing slits or electron passing through-holes are incident on the fluorescent plane. Thus, the light flux substantially proportional to the incident amount of electrons is discharged from the fluorescent body and passes through the fluorescent glass which is a screen so that the light flux is discharged externally from the CRT.

For example, as regards a certain model of electron gun, the aperture rate of the aperture grill or shadow mask, light emitting efficiency of the fluorescent body, permeability of the fluorescent glass, etc., can be regarded constant. For this reason, the substantial maximum current amount which must be discharged from the cathode in order to obtain predetermined image luminance can be uniquely determined. The upper limit of performance will be explained below. For example, as matters now stands, generally, the CRT for HDTV (High Definition Television) does not have sufficient luminance. The sufficient luminance can be obtained by increasing the current amount discharged from the cathode. But, an increase in the current commonly deteriorates the convergence in an electron beam. On the other hand, because the HDTV displays video images with high resolution, the HDTV is required to converge the electrons discharged from the cathode so that the current amount cannot be simply increased in order to maintain the resolution constant. Thus, the approximate maximum current amount which can be discharged in order to obtain a predetermined image quality can be determined uniquely.

The maximum current required to obtain the maximum luminance in a practical range in a certain model of CRT using an electron gun is called a practical maximum current. It can be defined as follows. The maximum luminance in the practical range is a necessary and sufficient value as luminance of this kind of model or a substantial value that this model can spell out as performance in a catalogue. The luminance that the model can provide but leads to the image quality which is not practical because of greatly reduced focusing does not refer to the maximum luminance in the practical range. Even when the practical maximum current is taken out, in almost all cases, the area of the electron discharge region is not larger than that of the first grid electron passing through-hole 7 and is about ¼ as large as thereof (i.e. ½ in diameter).

For example, assuming that the first grid electron passing through-hole 7 has a disk shape with a diameter of about 0.4 mm, even when the practical maximum current of the electron gun is taken out, the diameter of the electron discharging region in the electron discharging plane of the cathode may be about 0.2 mm. In this case, even when the electron dischargeable region is disk-shaped with a diameter of 0.3 mm which is smaller than that of the first grid electron passing through-hole 7, the effect of improving the focusing characteristic cannot be obtained. Further, even when the electron dischargeable region 3 has a diameter of 0.19 mm, the great effect of improving the focusing characteristic cannot be obtained because the amount of discharged electrons is little in the vicinity of the boundary of the electron discharging region.

SUMMARY OF THE INVENTION

The present invention has been accomplished to solve the above first problem and intends to provide an electron gun which can easily adjust alignment in center axes than the prior art.

The present invention has been accomplished to solve the above second problem and intends to provide an electron gun having an electron discharging region, a size of which is set to surely improve the convergence characteristic.

The first configuration of the present invention is an electron gun comprising a cathode for discharging electrons and a plurality of grids provided with electron passing-through holes for guiding the electrons discharged from the cathode unidirectionally, in that an electron dischargeable region in an electron discharging plane of said cathode is band-shaped.

The second configuration is an electron gun in the first configuration, in that the length of the band-shaped area constituting the electron dischargeable region on its shorter side is less than 80% of the diameter of the area from which electrons are discharged when a practical maximum current is taken out without limiting the electron dischargeable region.

The third configuration according to the present invention is an electron gun comprising a cathode for discharging electrons and a plurality of grids provided with electron passing-through holes for guiding the electrons discharged from the cathode unidirectionally, in that an electron dischargeable region in an electron discharging plane of said cathode is disk-shaped and a diameter of the electron dischargeable region is less than 80% of the diameter of the area from which electrons are discharged when a practical maximum current is taken out without limiting the electron dischargeable region.

The fourth configuration of the present invention is an electron gun in the first, second or third configuration, in that the surface of said electron dischargeable region has roughness within a range of 10 $\mu$m.

DETAILED DESCRIPTION OF THE PREFERRED EMBODIMENTS

Embodiment 1

Figure 1:
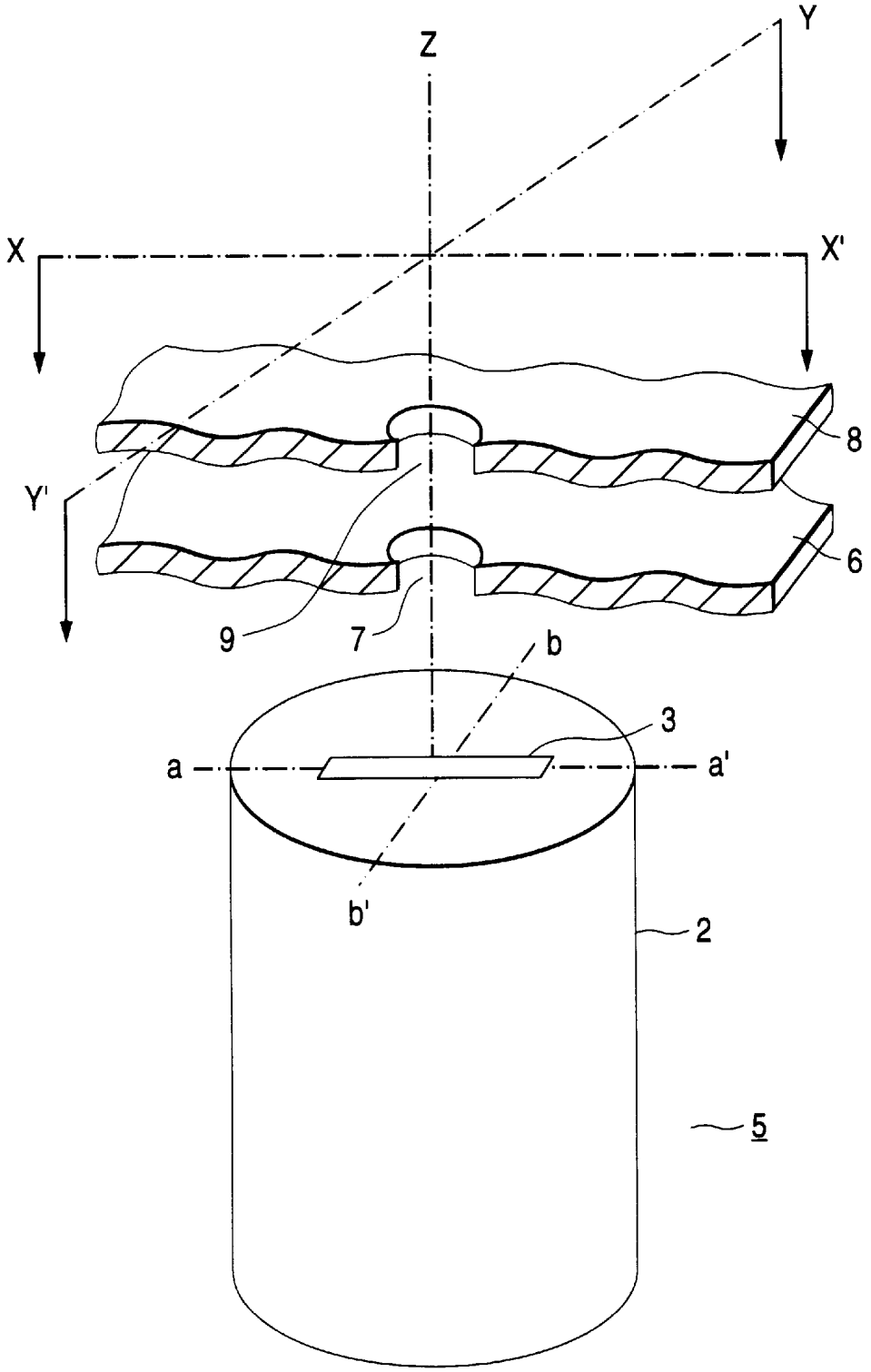
FIG. 1 is an enlarged perspective view of the vicinity of the an electron gun according to the first embodiment of the present invention.

An explanation will be given of the electron gun according to the first embodiment of the present invention. FIG. 1 is an enlarged perspective view of the vicinity of the an electron gun. This cathode is called an impregnated cathode. In FIG. 1, reference numeral 2 denotes a cathode sleeve and reference numeral 3 denotes an electron dischargeable region. The cathode sleeve 2 has a band-shaped, e.g. slender rectangular opening. A cathode pellet exposed from the opening constitutes an electron dischargeable region 3. On the side of a fluorescent screen (upper part in FIG. 1) of a cathode 5, a first grid 6 provided with a first grid electron passing though-hole 7 is arranged. Further, on the side of the fluorescent screen, a second grid 8 provided with a second grid electron passing through-hole 9 is arranged. The first grid 6 and second grid 8 are illustrated in recessed manner.

Figure 2:
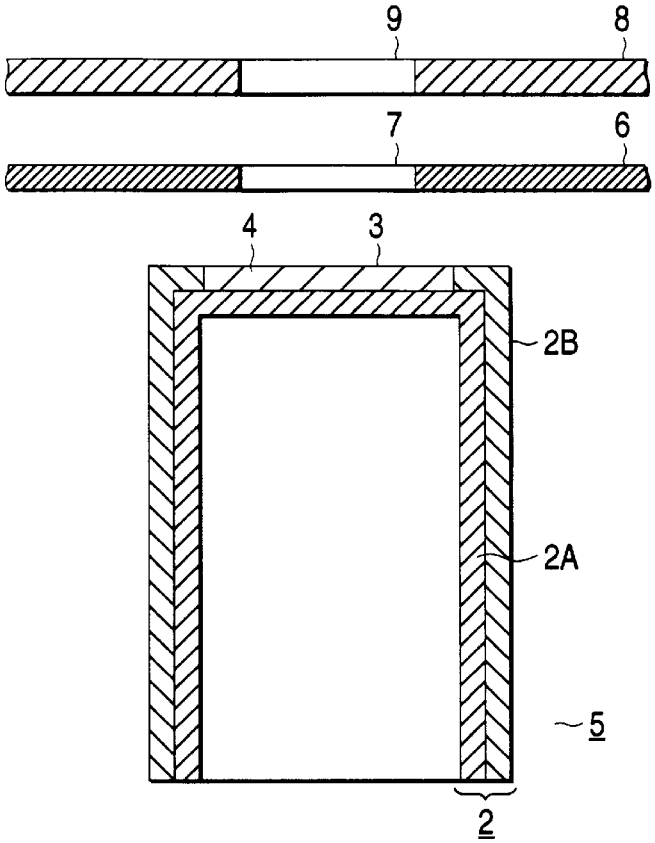
FIG. 2 is an enlarged sectional view of the vicinity of the cathode according to the first embodiment, taken in line X—X' in FIG. 1.
Figure 3:
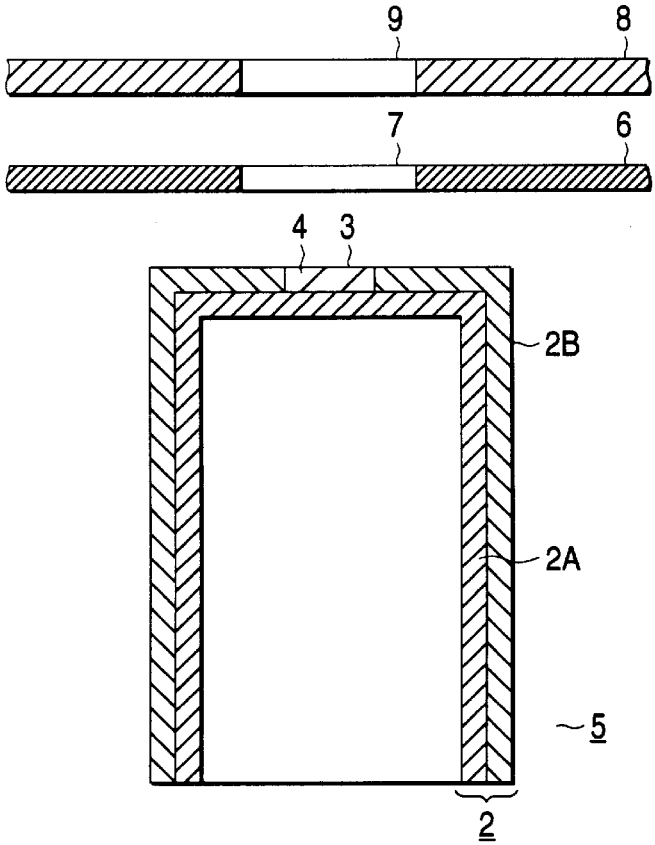
FIG. 3 is an enlarged sectional view of the vicinity of the cathode according to the first embodiment, taken in line Y—Y' in FIG. 1.

FIG. 2 is an enlarged sectional view of the vicinity of the cathode according to the first embodiment, taken in line X—X' in FIG. 1. FIG. 3 is a sectional view taken in line Y—Y'. The X—X' line corresponds to a horizontal direction of the fluorescent screen which is a display plane. The Y—Y' line corresponds to a vertical direction of the fluorescent screen. Now, the X—X' line, Y—Y' line and the direction of discharging electrons from the cathode 5 to the fluorescent screen are referred to as X direction, Y direction and Z direction, respectively.

Incidentally, in FIGS. 2 and 3, the heater to be provided within the cathode 5 are not shown.

In FIGS. 2 and 3, reference symbol 2A denotes an inner sleeve; 2B an outer sleeve; and 4 a cathode pellet. Although not shown, on the side of the fluorescent screen of the second grid 8 (upper portion in FIGS. 2 and 3), a third, fourth grid and fifth grid are provided. The first grid 6 is provided with a first grid electron passing through-hole 7 which is disk-shaped with a diameter of e.g., about 0.4 mm. The second grid 8 is provided with a second grid electron passing through-hole 9 which is disk-shaped with a diameter of e.g. about 0.4 mm. The opening of the outer sleeve 2B has a rectangular shape with long sides of 1 mm and short sides of 0.12 mm. As shown in FIG. 1, the center axis of the first grid electron passing through-hole 7 which is cylindrical and that of the second grid electron passing through-hole 9 which is also cylindrical are coincident to each other. The center axes are perpendicular to a symmetrical axis (a—a') in a horizontal direction of the electron dischargeable region 3 which is rectangular. The symmetrical axis (b—b') in a vertical direction is not required to have a cross-point with the center axes of the first grid electron passing through-hole 7 and the second grid electron passing though-hole 9. Therefore, alignment or positioning in a direction of the short sides is made with high accuracy whereas that in a direction of the long sides must be made so that the electron passing through-holes 7, 9 are opposed to the opening 3.

Figure 4:
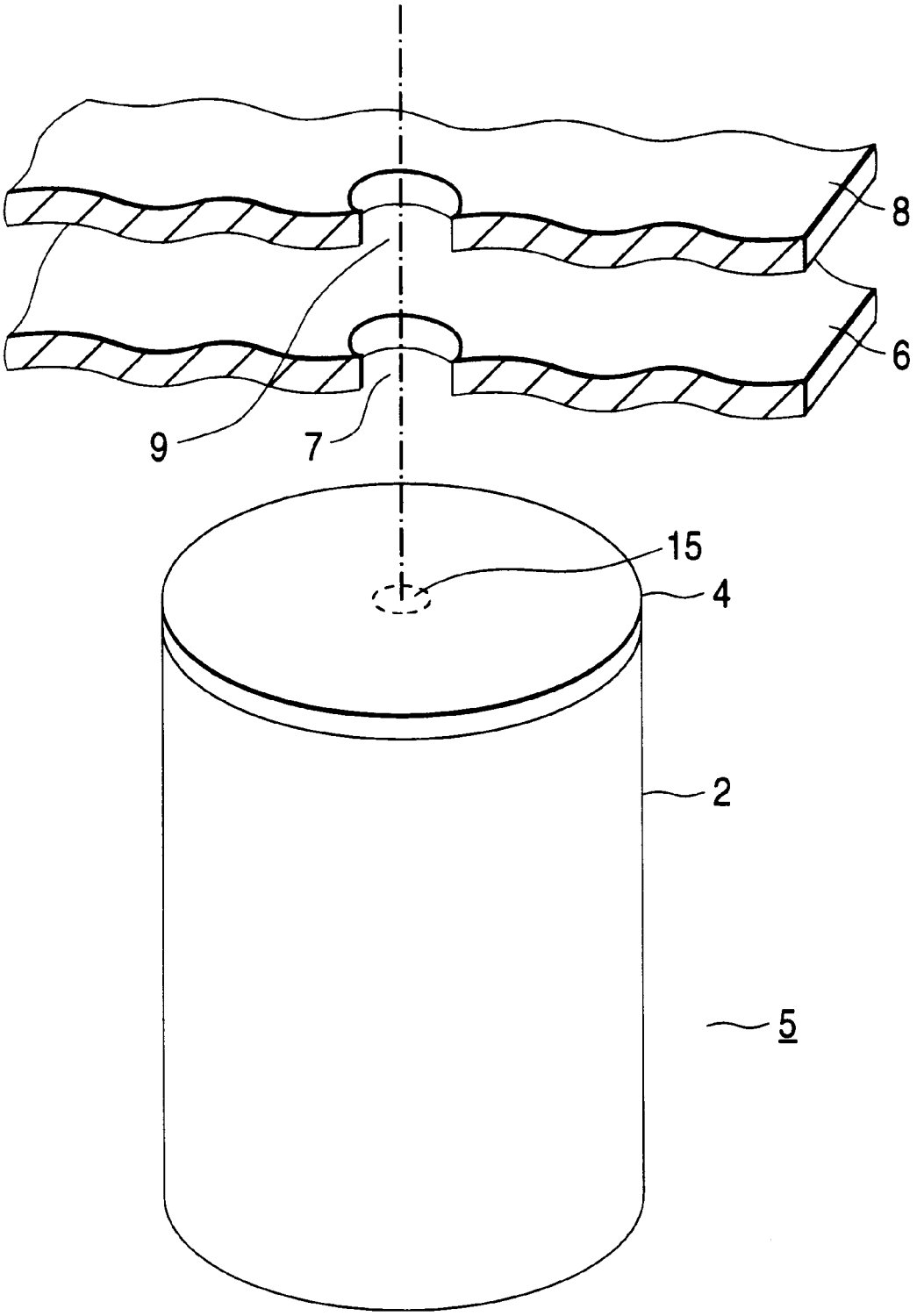
FIG. 4 is an enlarged perspective view of the vicinity of a general impregnated cathode which does not limit the electron dischargeable range according to the first embodiment.

FIG. 4 is an enlarged perspective view of the vicinity of a general impregnated type cathode which does not limit the electron dischargeable range. Unlike the slender band shape of the exposed portion of the cathode pellet 4 shown in FIG. 1, the entire electron discharging plane of the cathode 5 is exposed. In this case, the electron dischargeable region 3 is the entire electron discharging plane.

In FIG. 4, a range 15 indicated in dotted line represents an imaginary maximum active region when the practical maximum current of this electron gun is taken out. In FIG. 4, the electron gun is assumed which is different from the configuration shown in FIG. 1 in the shape of the electron dischargeable region 3 except the remaining electrode configuration and is adapted to discharge electrons from the entire electron discharging plane. The region where electrons are discharged from the cathode surface when the practical maximum current is taken out by this electron gun is called the imaginary maximum active region. In this case, the imaginary maximum active region 15 has a disk shape with a diameter of about 0.18 mm.

The electron gun as shown in FIGS. 1 to 3 has a slender rectangular shape 3 with a short side having a length of 0.12 mm which is about 67% of the diameter of 0.18 mm of the imaginary maximum active region 15. Namely, the length of the region confined in a band-shape from which electrons can be emitted in the electron discharging plane of the cathode is within a range less than 80% of the diameter of the region from which electrons are discharged when the practical maximum current is taken out without confining the electron dischargeable region.

An explanation will be given of two manners for evaluating the focusing characteristic of electrons discharged from the cathode.

The first evaluating method, as already described, is to evaluate the focusing characteristic in terms of the degree of coincidence of cross-over points. This method is simple but not precise. The higher the coincidence degree of crossover points is, the better the focusing characteristic is. For example, coincidence of all the cross-over points of electrons discharged from the cathode means very excellent focusing characteristic.

This is due to the following reason. By linear approximation of the loci of the electrons behind the crossover points, it can be roughly supposed that the electrons have been discharged linearly from the cross-over points. The locus of the electron beam is often judged from the point of view of optics. "Converging the electron beam discharged along a linear locus from an imaginary electron source by a field lens to obtain a spot with a smaller diameter on a screen plane" corresponds to "focusing the light emitted from a light source by an optical lens to obtain a spot with a smaller diameter on the screen". For example, the light emitted from a single point, at least its paraxial locus, is apt to be focused into the spot with a smaller diameter so that it can be focused into the single point. Likewise, a smaller electron source can be easily focused into a spot with a smaller diameter. For this reason, the higher degree of coincidence of cross-over points can estimate that electrons have been discharged from a smaller electron source, thus providing the electron beam with a good focusing characteristic.

The second method of evaluating the focusing characteristic of electrons is as follows.

Figure 5:
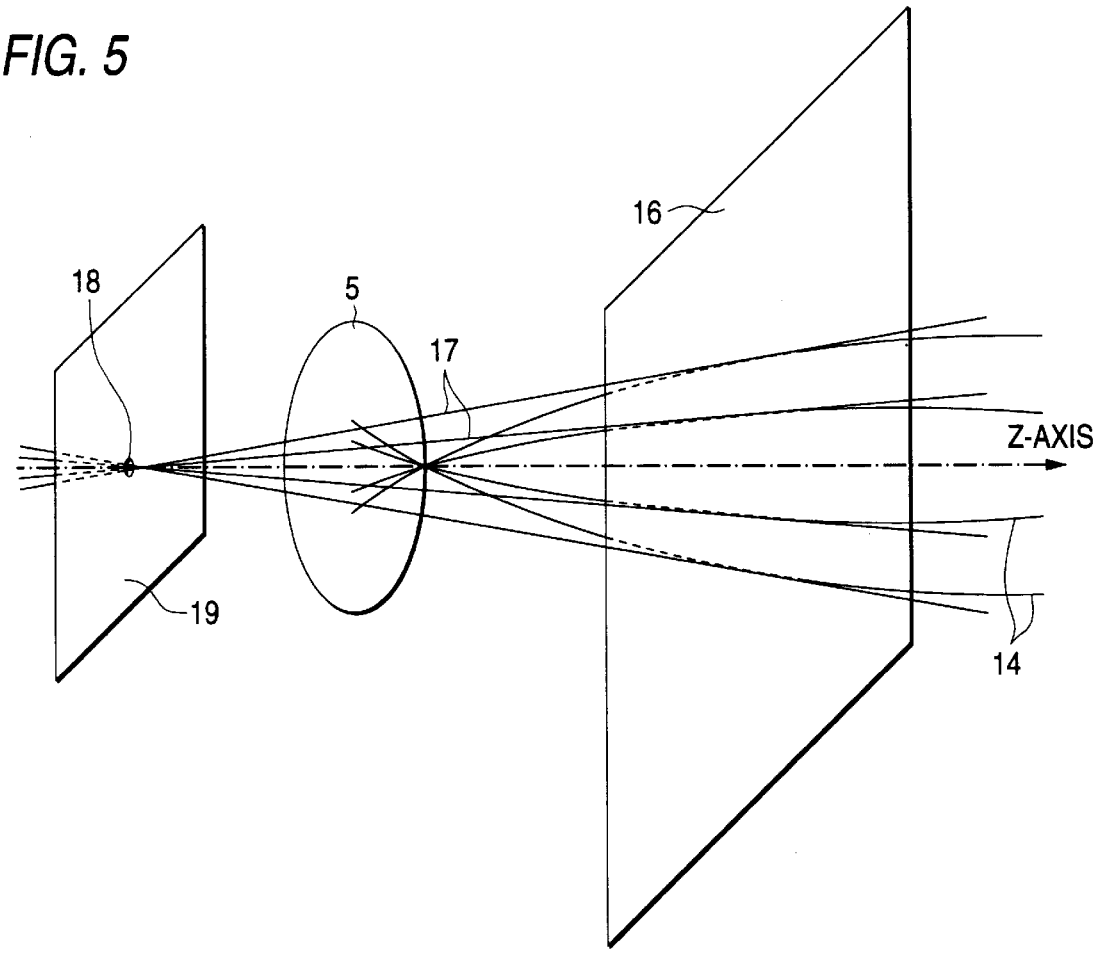
FIG. 5 shows a schematic view of the electron locus for explaining the emittance according to the first embodiment of the present invention.

The focusing characteristic of electrons discharged from the cathode can be evaluated using the value called "emittance". FIG. 5 shows a schematic view of the electron locus. Referring to FIG. 5, the emittance will be explained. Reference numeral 5 denotes a cathode. Only its portion from which electrons are discharged is illustrated. A Z-axis is provided to be coincident with the center axes of the respective electron passing through-holes of the first grid and second grid (not shown).

At a suitable position in the Z axis, e.g. at a position where the third grid is arranged, a plane 16 orthogonal to the Z axis is supposed. When the electron loci intersect the plane 16, intersecting points 14 of the respective loci and incident angles to the plane are obtained. Assuming that the respective electrons have been linearly incident on the intersecting points, imaginary electron loci lines 17 are drawn on the side of the cathode. The imaginary electron loci 17 are focused at a certain point at the most degree. This point is called an imaginary object point. Actually, the tangent can not be focused into a single point at the substantial point, but into a tiny area 18. This area corresponds to the imaginary object point.

Figure 6:
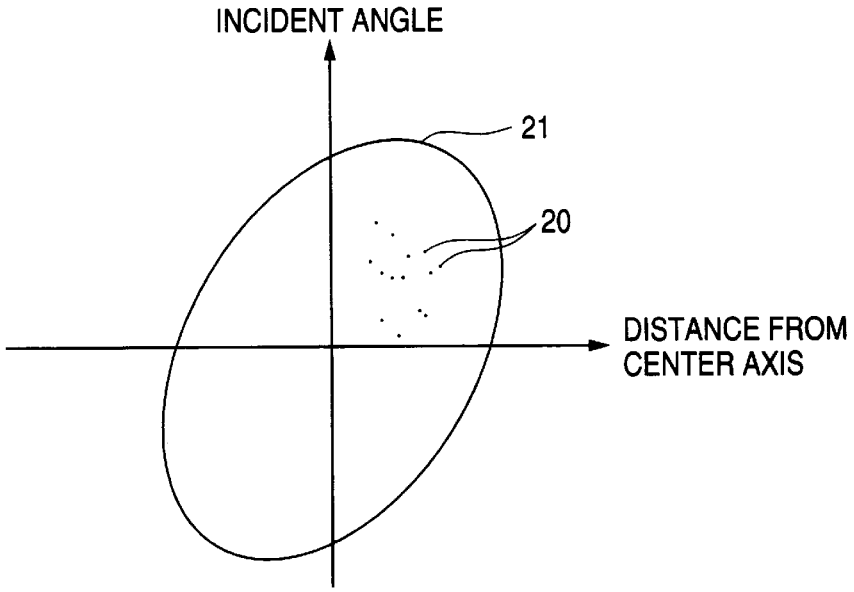
FIG. 6 is a characteristic graph representative of the phase of electron beams for explaining the emittance according to the first embodiment.

Supposing the plane 19 which is orthogonal to the Z axis at the imaginary object point, the distance from the Z-axis and incident angle to the plane are obtained for the respective imaginary electron loci 17. In this case, with the distance from the Z-axis (center axis) as an abscissa and the incident angle as an ordinate, a characteristic graph representative of electron beams as shown in FIG. 6 can be obtained. In FIG. 6, a point 20 corresponds to each locus of the electron. Actually, there are countless electron loci and hence these points form a certain region 21. The area of the region 21 is called emittance. A smaller emittance gives a smaller enlarging angle and imaginary object point, thus providing an electron beam with good focusing.

Figure 7:
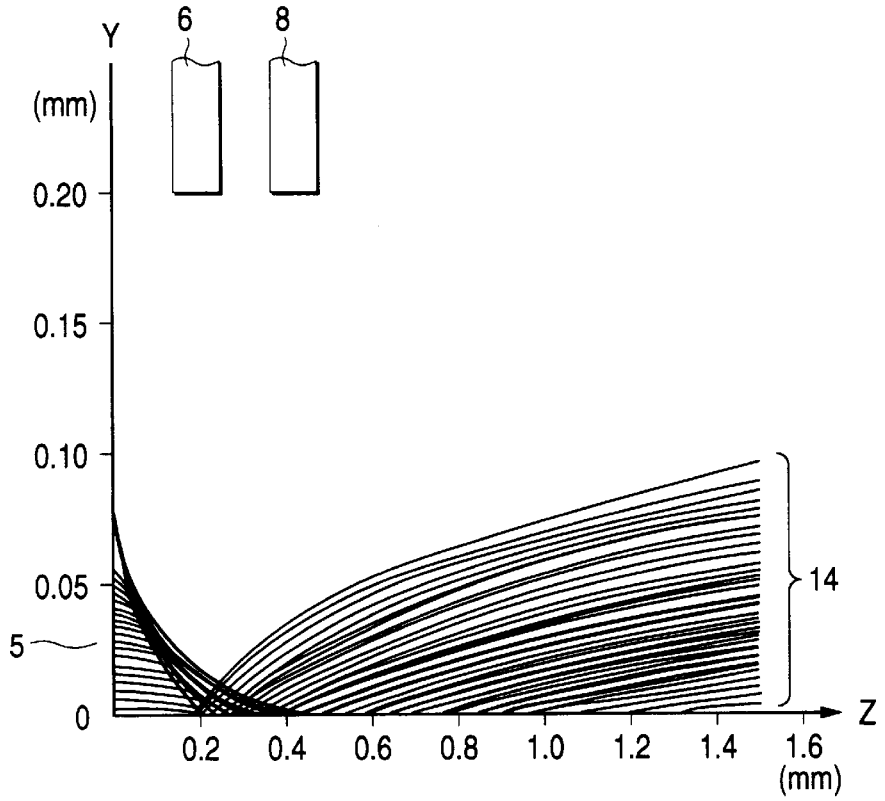
FIG. 7 is a graph showing the electron loci when electrons are discharged without limiting the electron discharging region according to the first embodiment.

FIG. 7 is a view for explaining the electron loci when electrons are discharged without limiting the electron dischargeable region 3. The abscissa represents the distance (mm) from the electron discharging plane of the cathode 5 whereas the ordinate represents the distance (mm) from the center axis. Only the upper half from the center axis is shown. As apparent from FIG. 7, the electrons discharged from positions remote from the center axis cross over at positions (left side of FIG. 7) near to the electron discharging plane, whereas the electrons discharged from the positions near to the center axis cross over on the side of the fluorescent screen (right side of FIG. 7) remote from the electron discharging plane of the cathode 5.

Figure 8:
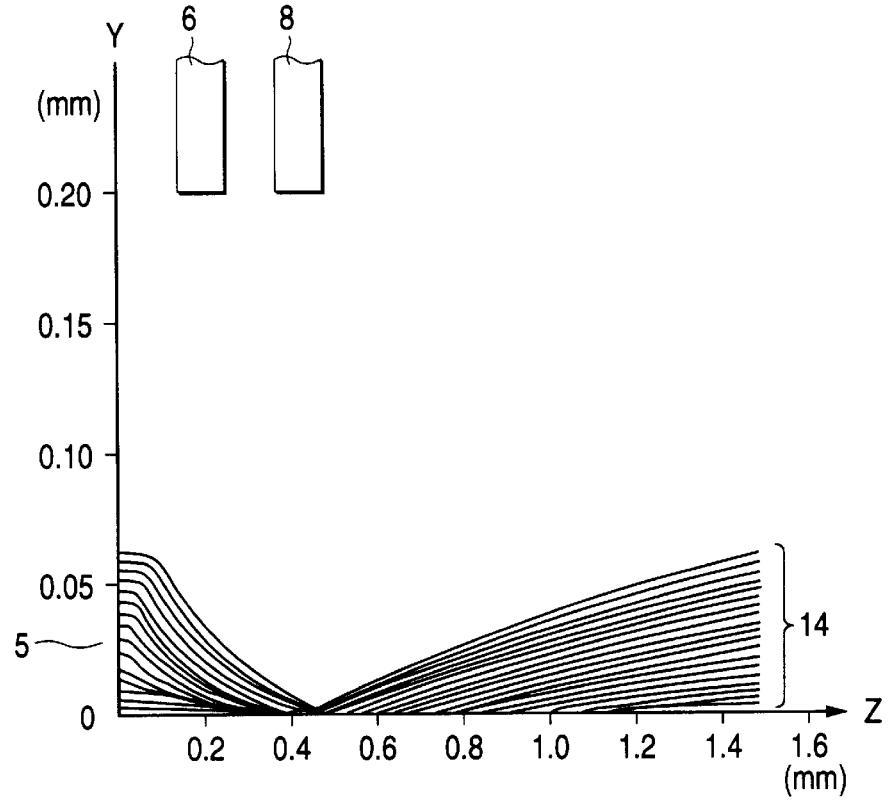
FIG. 8 is a graph showing the electron loci according to the first embodiment.

FIG. 8 is a view for explaining the electron locus according to an embodiment of the present invention, and shows the electron loci on the section in the Y-direction (vertical direction) in the vicinity of the cathode. Like FIG. 7, only the upper half from the center axis is shown in FIG. 7. In FIG. 8, each of the electron loci 14 is discharged from a circular area having a diameter of 0.12 mm (i.e. region of 0 to 0.06 mm) which is smaller than that of an imaginary maximum circular active area having a diameter of 0.18 mm (i.e. region of 0 to 0.09 mm from the center axis). Then, the cross-over points of electrons discharged from points remote from the center axis move towards the fluorescent screen (right side in FIG. 8). It can be seen that the cross-over points of the entire electron loci are coincident to one another as compared to FIG. 7. But it should be noted that the in the X-direction (horizontal direction), for which the electron dischargeable range is not limited, such a tendency is not obtained.

Figure 9:
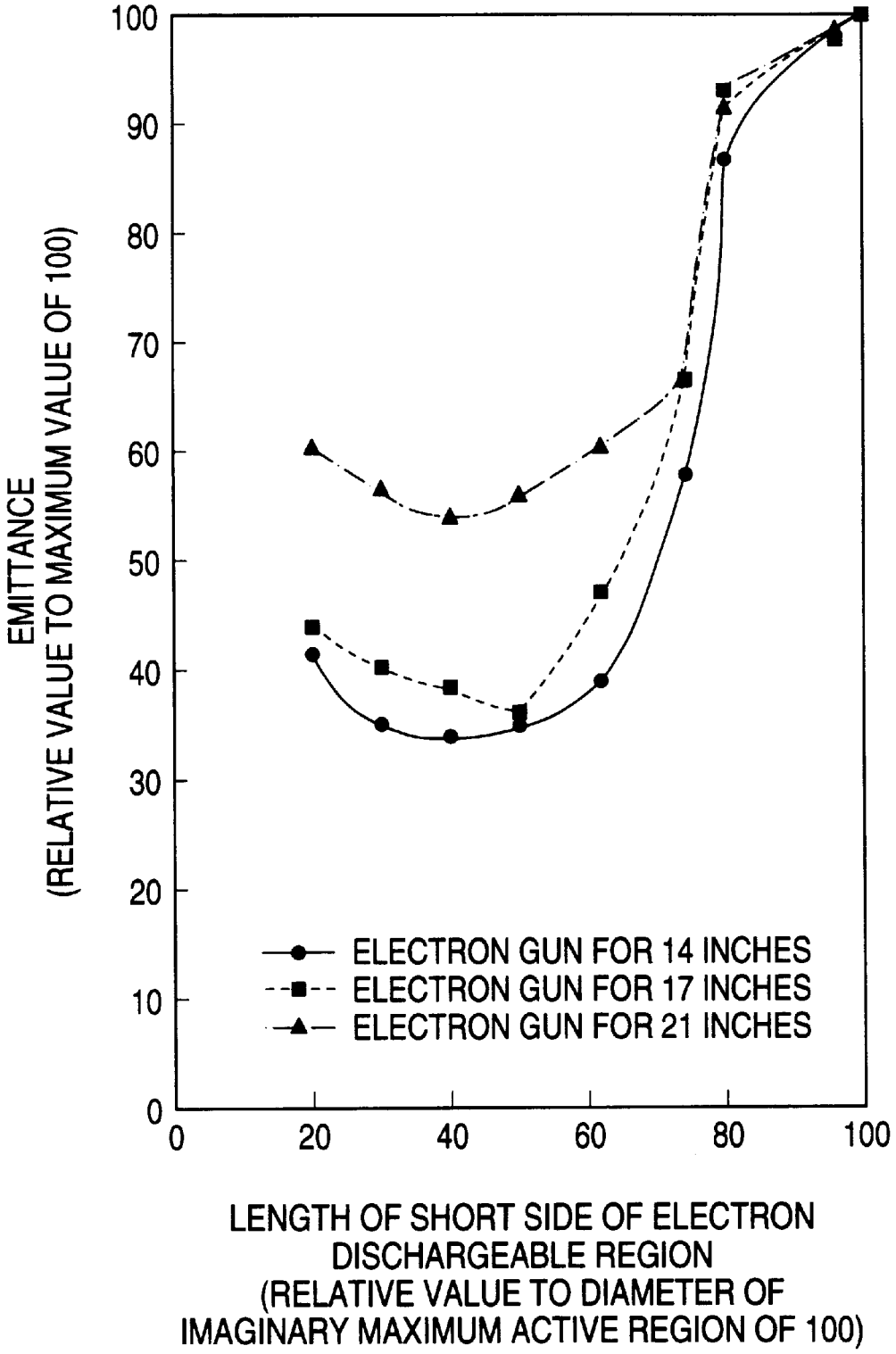
FIG. 9 is a graph showing the relationship between the length of the short side of a rectangular electron dischargeable region of each of three electron guns and emittance thereof.

FIG. 9 is a graph showing the relationship between the length of the short side of a rectangular electron dischargeable region of each of three electron guns and emittance thereof. In FIG. 9, the abscissa refers to the length of the short side of the electron dischargeable region, which is represented by a relative value to the diameter of an imaginary maximum active region of 100. The ordinate refers to the emittance, which is represented by a relative value to the maximum value of 100. The electron guns corresponding to three curves are selected from the electron guns for the display monitors with 14 inch, 17 inch and 21 inch. The discharged currents are set for the practical maximum current for the respective electron guns. The reason why the emittance is evaluated in terms of the practical maximum current is that the focusing characteristic becomes the worst when the maximum current is discharged. In the electron gun according to this embodiment, since the current is changed through a cathode voltage modulation, i.e., cathode drive, the voltage of cathode has been changed in order to adjust the current value to the necessary maximum value. As apparent from FIG. 9, even when the length of the short side of rectangle is decreased, the emittance does not vary greatly from 100% to 90%. But, the emittance starts to decrease abruptly from about 80%. This means that in order to reduce the emittance effectively, the length of the short side of the electron dischargeable region should be lower than 80% of a diameter of the imaginary maximum active region.

This is due to the following reason. The electrons discharged from remote portions from the center axis provide cross-over points in the vicinity of the cathode, which deteriorates the focusing characteristic. When the electrons are not discharged from this portion, the focusing characteristic is improved. Here it should be noted that this fact does not provide so large effects. However, as seen from FIG. 8, the effect of spatial charges increases when the length of the short side of the electron dischargeable region is lower than 80% of a diameter of the imaginary maximum active region. Thus, immediately after the electrons discharged from the positions remote from the center axis are discharged from the cathode, they repel toward the direction leaving from the center axis and approaches the center axis. Accordingly, the cross-over points of electrons discharged from the positions remote from the center axis are shifted to the side of the cross-over points so that coincidence of the cross-over points of the electrons discharged from the electron discharging plane can be realized. In this way, a decrease in the discharge of electrons which deteriorates the focusing characteristic and coincidence of the cross-over points occur simultaneously so that the focusing characteristic can be improved effectively.

However, smaller length of the short side does not always bring good results, as seen from FIG. 9, the emittance continues to decrease until the length of the short side of the electron dischargeable region becomes about 30%. But it starts to increase when it becomes 30% or less. This is because the cross-over points of electrons discharged from the positions remote from the center axis shifts excessively to the fluorescent screen, thus rather leading to an increase in the emittance. FIG. 9 has no plot where the length of the short side of the rectangle are lower than 20%. This means that the practical maximum current cannot be obtained when the above length is lower than 20% even if the cathode voltage is lowered to be equal to the voltage of the first grid. Thus, the excessively small electron discharging range makes it difficult to obtain the necessary current.

Figure 10:
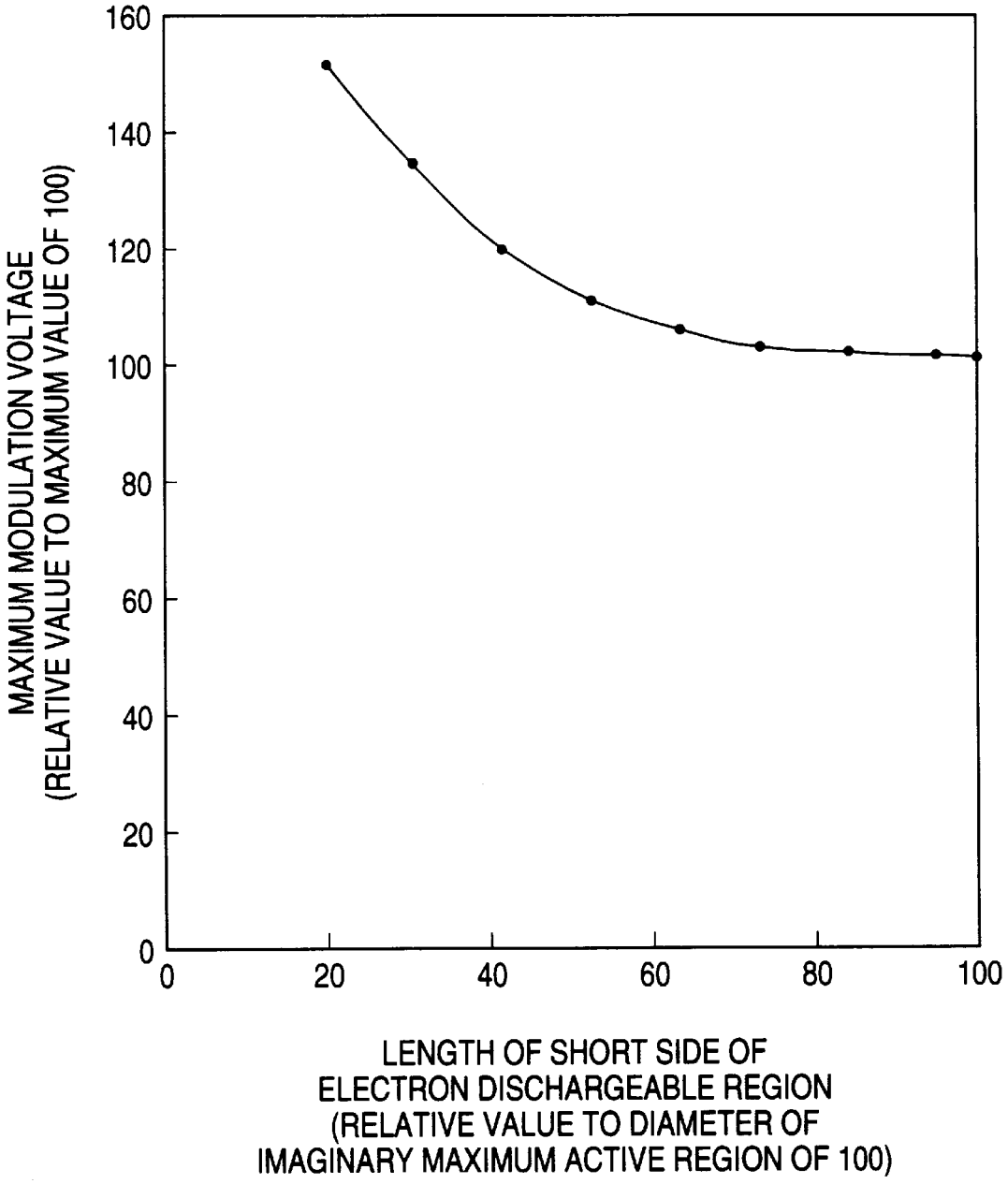
FIG. 10 is a graph showing the relationship between the length of the short side of the electron dischargeable region and the maximum modulation voltage of the cathode according to the first embodiment.

FIG. 10 is a graph showing the relationship between the length of the short side of the electron dischargeable region and the maximum modulation voltage of the cathode. In FIG. 10, the abscissa refers to the length of the short side of the electron dischargeable region, which is represented by a relative value to the diameter of an imaginary maximum active region of 100. The ordinate refers to the maximum modulation voltage, which is represented by a relative value to the maximum value of 100. Now it should be noted that the maximum modulation voltage of the cathode refers to a difference between the cathode voltage providing a discharging current of zero and that providing the practical maximum current. Since a larger cathode modulation voltage gives a large burden to the drive circuit, a smaller cathode modulation is preferable. When the length of the short side is shortened, the maximum modulation voltage is increased. For this reason, the length of the short side of a rectangle of the electron dischargeable region must be set to a suitable value being less than 80% of the diameter of the imaginary maximum active region, but not being excessive small. As apparent from FIGS. 9 and 10, the length of the short side can be a value in a range 30% to 40% without any problems.

In short, if the length of a short side of a rectangle which is an electron dischargeable region is set within a range of less than the diameter of the imaginary maximum active region, an electron gun can be obtained which gives the great effect of focusing the electron beams.

In the first embodiment, the length of the short side of the rectangle which is an electron dischargeable region is set, for example, at 67% of the imaginary maximum active region which satisfies a range of less than 80%. Thus, the great effect of focusing electron beams can be obtained. In addition, since position alignment is required for the direction of the length of the short side, i.e. only the Y direction, it can be made relatively easy.

In this embodiment, in order to enhance the focusing characteristic in a vertical direction, the electron dischargeable region is defined with the long side in the horizontal direction and the short side in a vertical direction. But, inversely, in order to improve the focusing characteristic in the horizontal direction, it may be defined as a band lengthy in the vertical direction. Further, it may be inclined in a certain direction which is not the horizontal and vertical directions. Such a preferable design may be selected in accordance with an electron gun or an CRT in which the electron gun is used.

In this embodiment, although the shape of the electron dischargeable region was a rectangle, it is not necessarily precise, but may be a slender band which permits the electron discharging range to be substantially limited in any direction to require the alignment in only the one direction.

Embodiment 2

Figure 11:
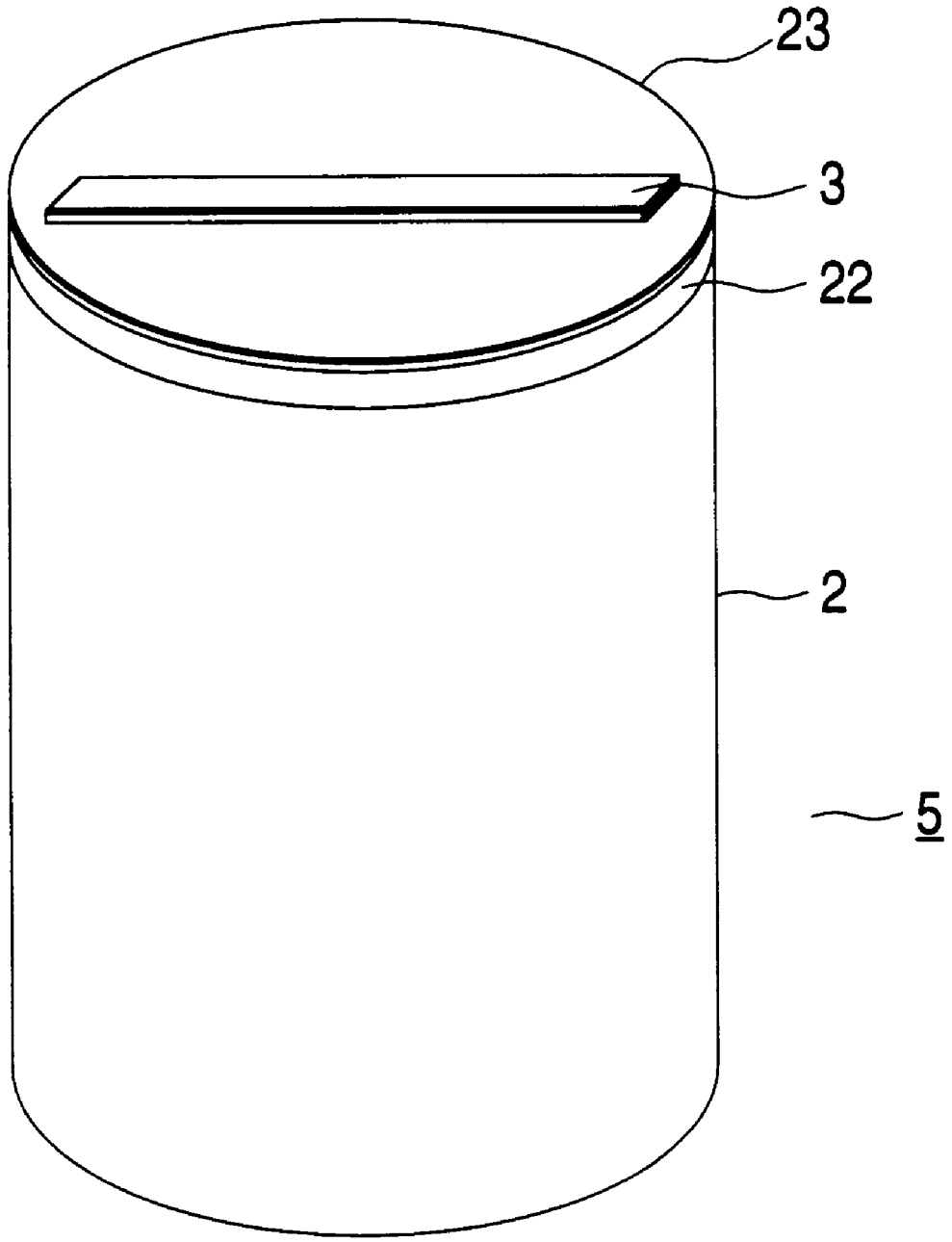
FIG. 11 is an enlarged perspective view of the vicinity of the an electron gun according to the second embodiment of the present invention.

Referring to the drawings, an explanation will be given of the electron gun according to the second embodiment. FIG. 11 is a perspective view of the electron gun according to the second embodiment with an enlarged vicinity of the cathode. The first embodiment was directed to the impregnated cathode whereas this embodiment is directed to the cathode to which an electron discharging substance is applied. In FIG. 11, reference numeral 2 denotes a cathode sleeve, and 22 denotes a disk of e.g. Ni (nickel) provided on the side of a fluorescent screen (upper part in FIG. 11). A fluorescent discharging substance 23 is applied to the fluorescent screen side of the disk 22. The electron discharging substance 23 may be e.g. ternary carbonate $\{(Ba/Sr/Ca)CO_3\}$.

The cathode according to this embodiment is formed in such a way that after the electron discharging substance 23 is uniformly applied to the entire electron discharging plane of the cathode on which the disk 22 of Ni is formed, pressure is applied, except to a rectangular region, from above to protrude the rectangular electron dischargeable region 3. In this embodiment, the electron discharging substance 23 may be the substance which can be compressed easily by pressure.

More specifically, with the electron discharging substance 23 applied to have a thickness of 100 $\mu$m–120 $\mu$m, it is pressurized except for the rectangle of the electron dischargeable region 3. The protruding height is e.g., 20 $\mu$m to 40 $\mu$m and the surrounding pressed portion has a thickness of 60 $\mu$m to 80 $\mu$m.

Like the first embodiment, the length of the short length of the rectangle which is an electron dischargeable region 3 is 0.12 mm which is within a range of less than 80% of the diameter of 0.18 mm of the imaginary maximum active region.

The electron discharging substance 23 on the pressurized portion is lowered in its electron discharging capability and far from the second grid serving as an electron extracting electrode so that electrons are difficult to be discharged therefrom. Thus, only the non-pressurized portion can be used as an electron dischargeable region 3.

Further, in this embodiment, the surface of the electron discharging substance 23 is formed to have roughness of 10 $\mu$m or less. The surface roughness within a range of 10 $\mu$m can be realized by adjusting the viscosity of the electron discharging substance 23 to be applied.

In this embodiment, although the electron discharging substance 23 was applied using a spray, it may be applied using a printing technique instead of application by the spray.

As seen from FIG. 8, in order that the emittance is effectively reduced by confining the area of the electron dischargeable region 3, the discharged electrons must be discharged perpendicular from the electron discharging plane of the cathode. On the other hand, where the electron discharging plane of the cathode has roughness in a certain degree, the electrons are not discharged about perpendicular from the electron discharging plane of the cathode. This leads to inconsistency in the cross-over points thereof, thus deteriorating the emittance.

Figure 12:
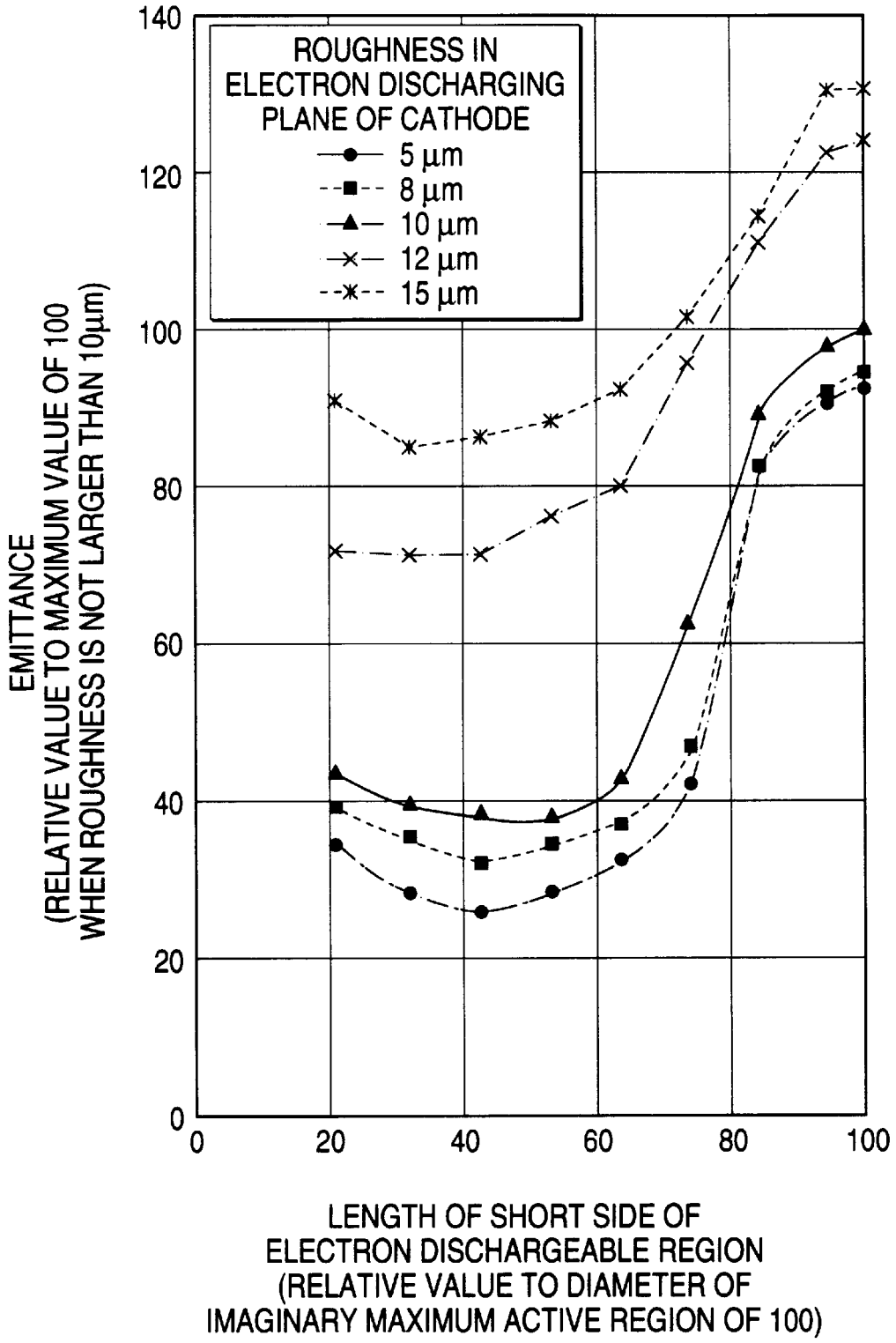
FIG. 12 is a graph showing the relationship between the roughness of the electron discharging plane of the cathode and emittance.

FIG. 12 is a graph showing the relationship between the surface roughness of the electron discharging plane of the cathode and emittance. In FIG. 12, the abscissa refers to the length of the short side of the electron dischargeable region, which is represented by a relative value to the diameter of an imaginary maximum active region of 100. The ordinate refers to the emittance, which is represented by a relative value to the maximum value of roughness within 10 $\mu$m of 100. Plural curves refer to the results when the roughness of the electron discharging plane of the cathode are changed like 5 $\mu$m, 8 $\mu$m, 10 $\mu$m, 12 $\mu$m and 15 $\mu$m. As seen from FIG. 12, as the roughness of the electron discharging plane is smaller, the emittance can be improved more greatly, thus providing a small absolute value of the emittance, i.e, good result. Particularly, when the coarseness is set for not larger than 10 $\mu$m, the effect of improving the emittance is remarkable. For this reason, in order to reduce the emittance effectively, the coarseness of the electron discharging plane of the cathode is desired to be not larger than 10 $\mu$m.

In the second embodiment also, the length of the short side of the rectangle which is an electron dischargeable region is set in the range less than 80% of the diameter of the imaginary maximum active region. Thus, the great effect of focusing electron beams can be obtained. In addition, since position alignment is required for only the direction of the short side, an electron gun which can realize the position alignment easily can be obtained.

Further, since the coarseness of the surface of the electron dischargeable region 3 is set for not larger than 10 $\mu$m in the electron discharging plane of the cathode, an electron gun can be obtained which discharges electrons perpendicular to the electron discharging plane to confine the area of the electron dischargeable region to improve the focusing characteristic effectively.

Embodiment 3

Figure 13:
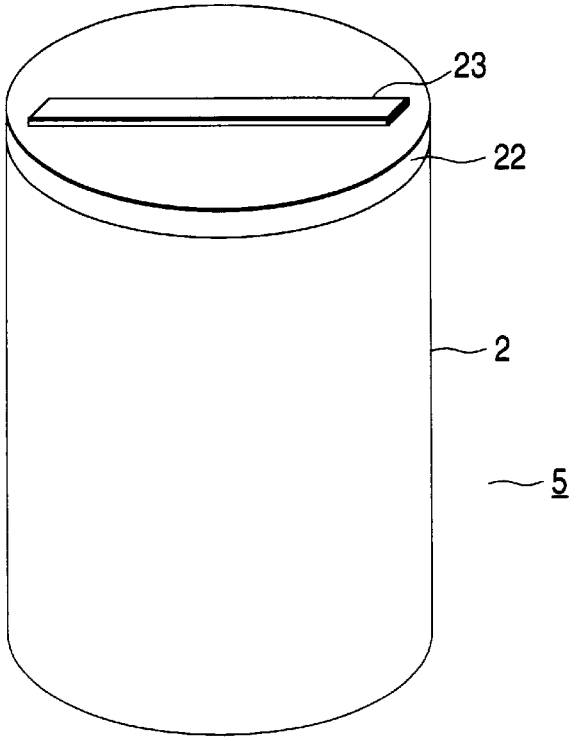
FIG. 13 is an enlarged perspective view of the vicinity of the cathode of an electron gun according to the third embodiment of the present invention.

Referring to the drawings, an explanation will be given of an electron gun according to the third embodiment. FIG. 13 is a perspective view of the electron gun according to the third embodiment with an enlarged vicinity of the cathode. In this embodiment also, the electron discharging substance is applied to form the cathode. As seen from FIG. 13, in this embodiment, the electron discharging substance 23 is applied to a rectangle with the short side of 0.12 mm of the disk 22, and no electron discharging substance is applied to the other remaining area than the rectangle. Only the area of the rectangle on which the electron discharging substance is applied serves as an electron dischargeable region.

In this embodiment also, the length of the short side of the rectangle which is an electron dischargeable region is set within a range less than 80% of the diameter of the imaginary maximum active region. Thus, the great effect of focusing electron beams can be obtained. In addition, since position alignment is required for only the direction of the short side of the rectangle, the position alignment can be easily realized. Unlike the second embodiment, electron discharging substance 23 is formed on the electron dischargeable region so that the electron dischargeable region can be defined surely.

Embodiment 4

Figure 14:
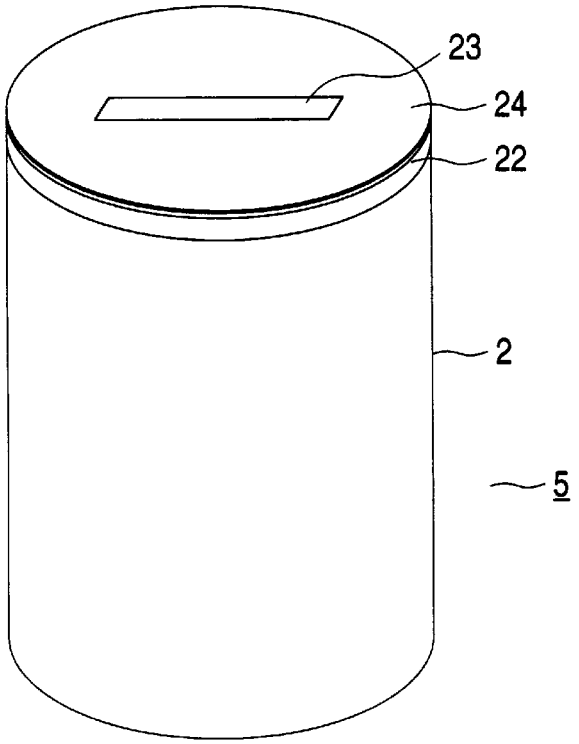
FIG. 14 is an enlarged perspective view of the vicinity of the cathode of an electron gun according to the fourth embodiment of the present invention.

Referring to the drawings, an explanation will be given of an electron gun according to the fourth embodiment. FIG. 14 is a perspective view of the electron gun according to the fourth embodiment with an enlarged vicinity of the cathode. In FIG. 14, reference numeral 24 denotes a deposited layer of metal such as nickel (Ni) and tungsten (W).

The electron discharging substance 23 is applied to the plane of the side (upper part of FIG. 14) of the fluorescent screen of the electron discharging substance 23 of the disk 22 of nickel. The metallic deposited layer 24 is formed on the side of the fluorescent screen of the electron discharging substance 23. This deposited layer 24 is formed except the electron dischargeable region. More specifically, it is formed on the plane on the side of the fluorescent screen of the electron discharging substance 23 except for a rectangle with a short side of 0.12 mm. The electron discharging substance 23 is exposed through the rectangle and serves as an electron dischargeable region.

In this embodiment also, the length of the short side of the rectangle which is an electron dischargeable region is set within a range less than 80% of the diameter of the imaginary maximum active region. Thus, the great effect of focusing electron beams can be obtained. In addition, since position alignment is required for only the direction of the short side, an electron gun which can realize the position alignment easily can be obtained.

In this embodiment, although the electron discharging substance 23 is covered with the metallic deposited layer, it may be covered by another means. For example, it may be covered with a metallic foil or metallic electrode having a rectangular opening.

Embodiment 5

Figure 15:
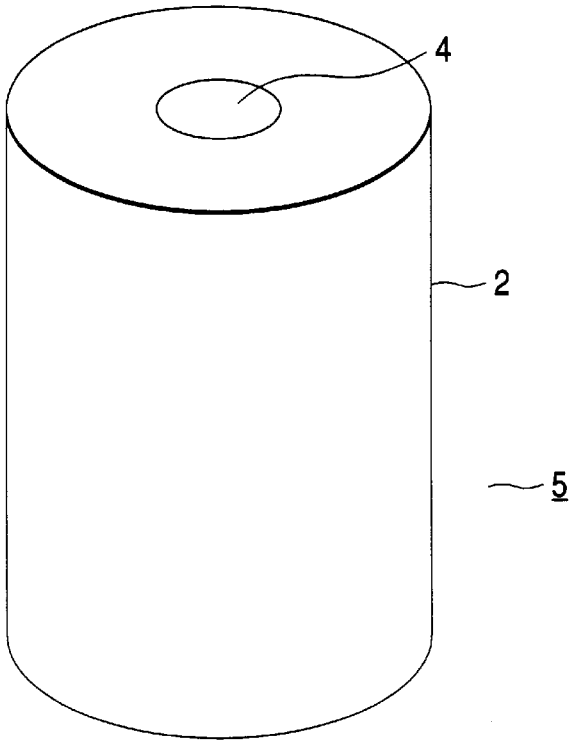
FIG. 15 is an enlarged perspective view of the vicinity of the cathode of an electron gun according to the fifth embodiment of the present invention.
Figure 16:
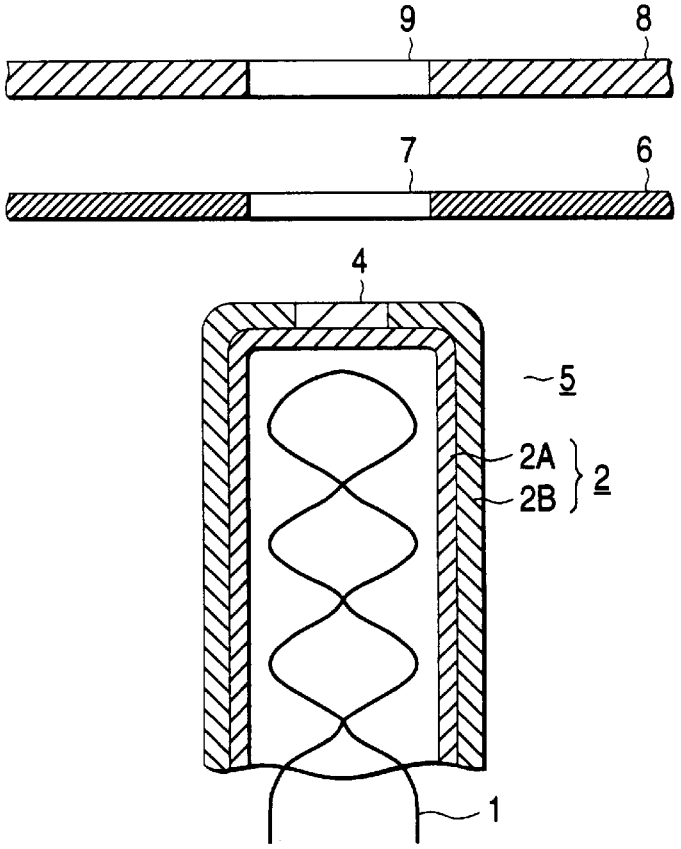
FIG. 16 is an enlarged sectional view of the vicinity of the cathode of an electron gun according to the fifth embodiment of the present invention.

Referring to the drawing, an explanation will be given of an electron gun according to the fifth embodiment of the present invention. FIG. 15 is a perspective view of the electron gun according to the fifth embodiment with an enlarged vicinity of the cathode. FIG. 16 is an enlarged sectional view of the vicinity of the cathode according to this embodiment. The cathode according to this embodiment is an impregnated cathode like the first embodiment.

As seen from FIG. 6, the cathode sleeve 2 includes an inner sleeve 2A and an outer sleeve 2B. On the side of the fluorescent screen (upper side in FIG. 16), the first grid 6 and the second grid 2 are provided. Further, on the side of the fluorescent screen, a third, a fourth and a fifth grid (not shown) are provided. The first grid 6 has a first grid electron through-hole 7 which is disk-shaped to have a diameter of about 0.4 mm. The second grid 8 has a second grid electron through-hole 9 which is disk-shaped to have a diameter of about 0.4 mm. The opening of the outer sleeve 2B is disk-shaped to have a diameter of e.g. 0.12 mm. The center axis of the first grid electron through-hole 7 which is cylindrical is coincident to that of the second grid electron through-hole 9 which is also cylindrical. On this center axis, the opening of the outer sleeve 2B is arranged. From the opening of the outer sleeve 2B, a cathode pellet is exposed to constitute an electron dischargeable region. Like the first embodiment, in this configuration, the imaginary maximum active region when the practical maximum current is taken out is disk-shaped to have a diameter of 0.18 mm.

In this embodiment, the electron dischargeable region is disk-shaped to have a diameter of 0.12 mm which is about 67% of the diameter of 0.18 mm of the imaginary maximum active region. Namely, the diameter of the electron dischargeable region in the electron discharging plane of the cathode is within a range less than 80% of the diameter of the region from which electrons are discharged when the practical maximum current is taken out without confining the electron dischargeable region.

Electrons are discharged from the range having a diameter of 0.12 mm which is smaller than that (0.18 mm) of the imaginary maximum active region. For this reason, the crossover points of electrons discharged from the area remote from the center axis moves towards the fluorescent screen. It can be seen that the cross-over points of the entire electron loci are coincident to one another as compared with the case where the electron dischargeable region is not confined.

Figure 17:
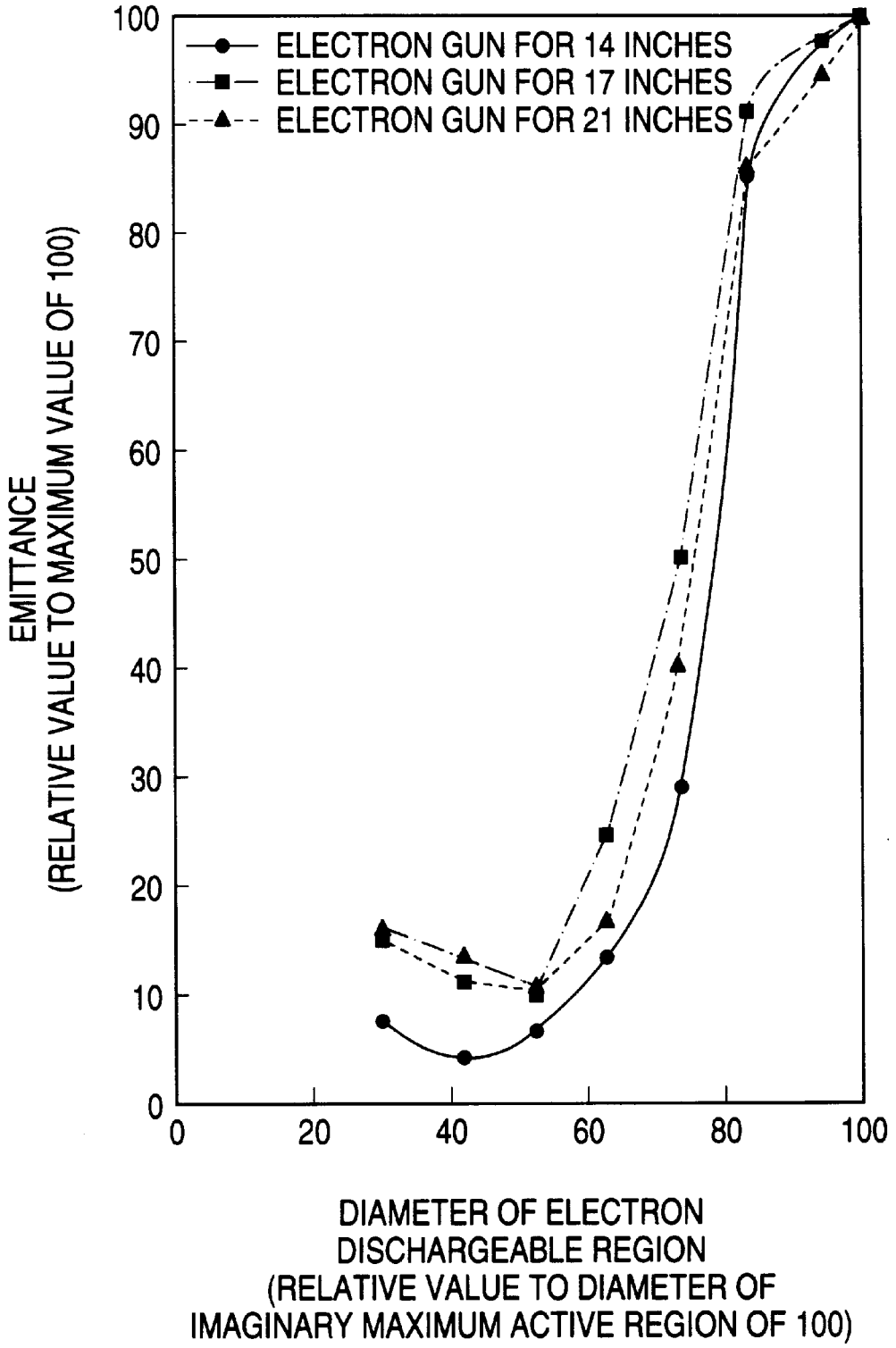
FIG. 17 is a graph showing the diameter of the electron dischargeable region and emittance according to the fifth embodiment of the present invention.

FIG. 17 is a graph showing the relationship between the emittance and the diameter of the electron dischargeable region of each of three electron guns. In FIG. 17, the abscissa refers to the diameter of the electron dischargeable region, which is represented by a relative value to the diameter of an imaginary maximum active region of 100. The ordinate refers to the emittance, which is represented by a relative value to the maximum value of 100. The electron guns corresponding to three curves are selected from the electron guns for the display monitors with 14 inch, 17 inch and 21 inch. The discharged currents are set for the practical maximum current for the respective electron guns.

As apparent from FIG. 17, even when the diameter of the electron dischargeable region is decreased, the emittance does not vary greatly from 100% to 90%. But, the emittance starts to decrease abruptly from about 80%. Therefore, in order to reduce the emittance effectively, the diameter of the electron dischargeable area must be lower than 80% of the imaginary maximum active region.

However, smaller diameter of the electron dischargeable region does not always bring good results, as seen from FIG. 17, the emittance continues to decrease until the diameter of the electron dischargeable region becomes about 40%. But it starts to increase again when it becomes 40% or less. This is because the cross-over points of electrons discharged from the positions remote from the center axis shifts excessively to the fluorescent screen, thus rather leading to an increase in the emittance. FIG. 17 has no plot where the diameter of a circle is lower than 30%. This means that the practical maximum current cannot be obtained when the above diameter is lower than 30%. The lower limit of the range of the electrons dischargeable region is defined by the design of the electron guns such as voltages applied to the electrodes, diameters of the electrodes, the distances between the electrodes, or the like.

Figure 18:
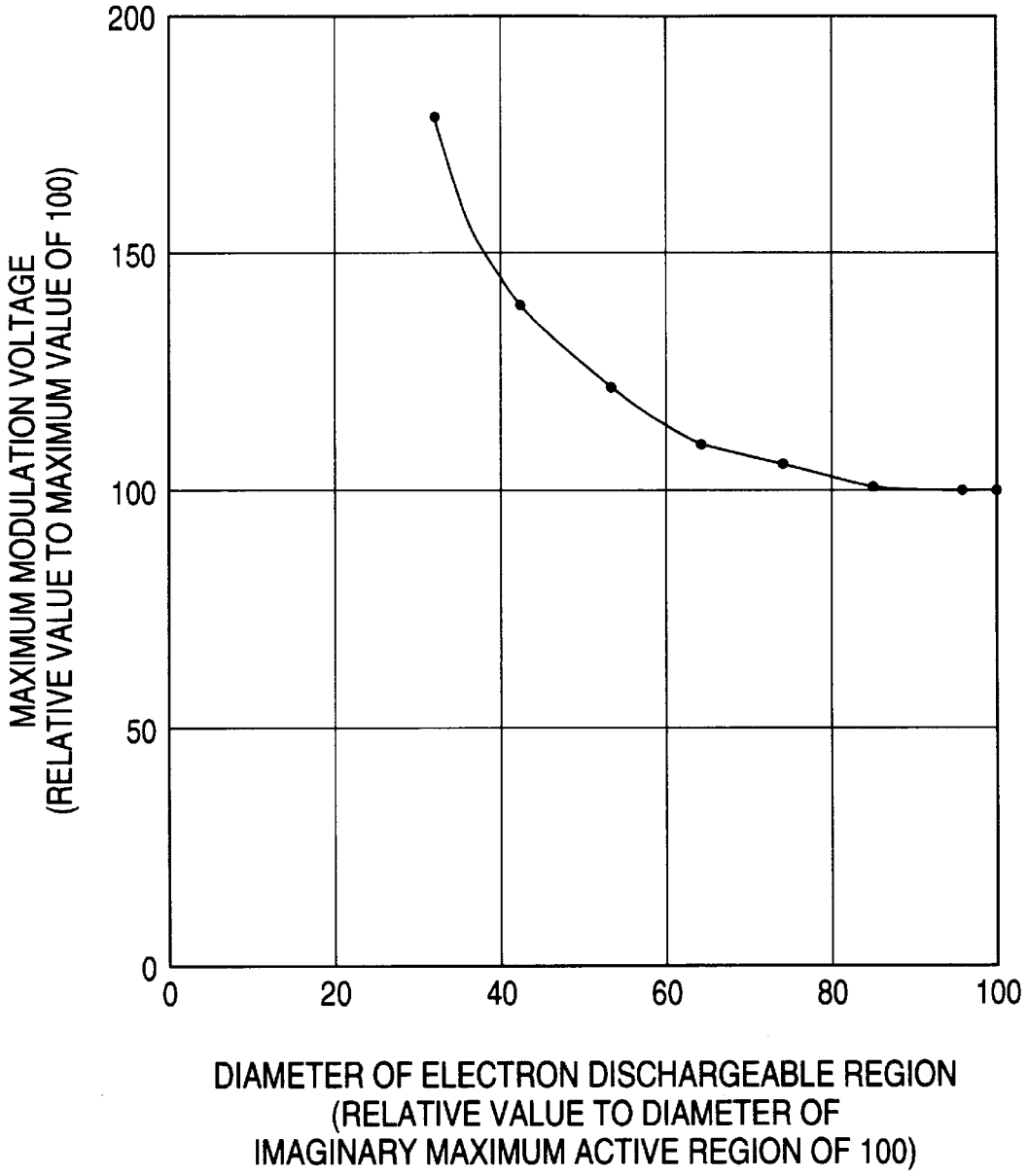
FIG. 18 is a graph showing the relationship between the length of the short side of the electron dischargeable region and the maximum modulation voltage of the cathode according I to the fifth embodiment.
Figure 19:
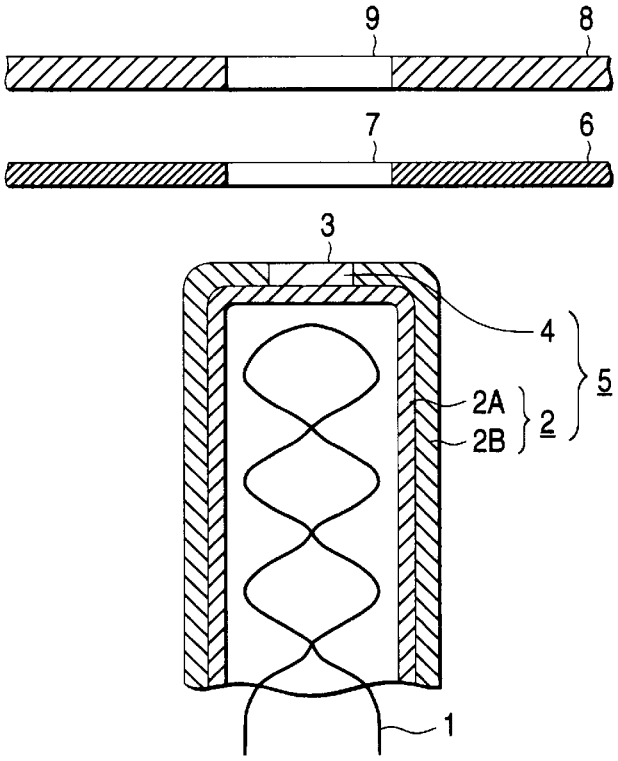
FIG. 19 PRIOR ART
FIG. 19 is an enlarged sectional view of a conventional electron gun.
Figure 20:
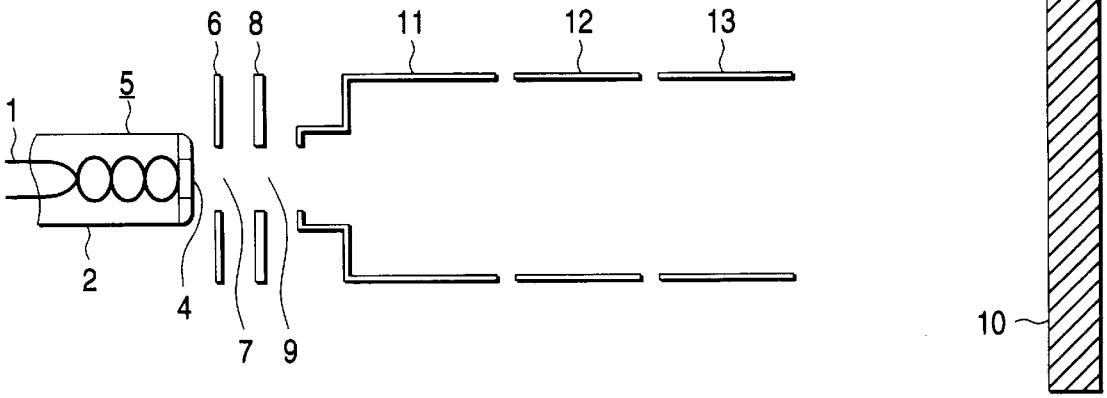
FIG. 20 PRIOR ART
FIG. 20 is a sectional view showing the entire configuration of a CRT to which the conventional electron gun is applied.
Figure 21:
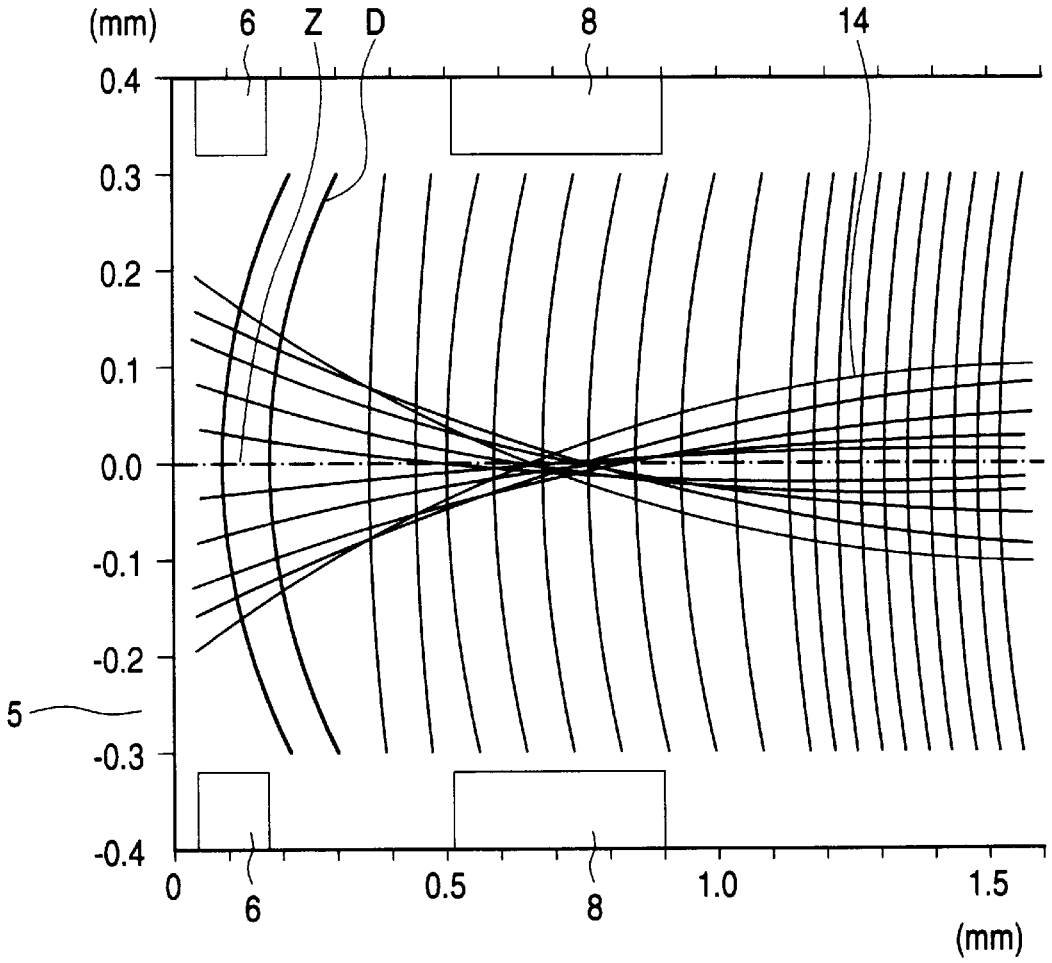
FIG. 21 PRIOR ART
FIG. 21 is a view for explaining the electron loci of electrons discharged from the cathode according to the conventional electron gun.

FIG. 18 is a graph showing the relationship between the diameter of the electron dischargeable region and the maximum modulation voltage of the cathode. In FIG. 10, the abscissa refers to the diameter of the electron dischargeable region, which is represented by a relative value to the diameter of an imaginary maximum active region of 100. The ordinate refers to the maximum modulation voltage, which is represented by a relative value to the maximum value of 100. When the diameter is small, the maximum modulation voltage is increased. For this reason, the diameter of the electron dischargeable region must be set to a suitable value being less than 80% of the diameter of the imaginary maximum active region, but not being excessive small. As apparent from FIGS. 17 and 18, the diameter can be set to a value in a range 30% to 40% without any problems.

In short, if the diameter of the circle constituting an electron dischargeable region is set within a range less than 80% of the diameter of the imaginary maximum active region, an electron gun can be obtained which gives the great effect of focusing the electron beams.

In this embodiment, since the diameter of the circle which is an electron dischargeable region is set for 67% of the imaginary maximum active region, the great effect of focusing electron beams can be obtained. In addition, since the electron discharging region is disk-shaped, the focusing characteristic in both vertical and horizontal direction can be improved. In this way, the effect of improving the focusing characteristic can be obtained surely and effectively, and injurious effects of an increase in the cathode drive voltage and a decrease in the cathode life can be minimized. But it should be noted that the position alignment, which requires axis alignment, is more difficult than the first embodiment.

In this embodiment, although the electron dischargeable range is disk-shaped, it may be elliptical. In this case, if the short and long diameters of the ellipse are set within a range less than 80% of the diameter of the imaginary maximum, the great effect of the focusing characteristic in both vertical and horizontal directions of the electron beam can be obtained. Where the electron dischargeable region is elliptical, a difference in the focusing characteristic in the horizontal and vertical direction occurs. Such a preferable design, however, may be selected in accordance with an electron gun or an CRT in which the electron gun is used.

In accordance with the first configuration of the present invention, in an electron gun comprising a cathode for discharging electrons and a plurality of grids provided with electron passing-through holes for guiding the electrons discharged from the cathode unidirectionally, an electron dischargeable region in an electron discharging plane of said cathode is band-shaped. For this reason, an electron gun is provided which can improve the focusing characteristic in either of both horizontal or vertical direction and realize the position alignment relatively easily.

In accordance with the second configuration of the present invention, in the first configuration, the length of the band-shaped area constituting said electron dischargeable region on its shorter side is less than 80% of the diameter of the area from where electrons are discharged when a practical maximum current is taken out without limiting the electron dischargeable region. For this reason, an electron gun can be provided which can improve the focusing characteristic of electron beams surely and effectively.

In accordance with the third configuration of the present invention, in an electron gun comprising a cathode for discharging electrons and a plurality of grids provided with electron passing-through holes for guiding the electrons discharged from the cathode unidirectionally, an electron dischargeable region in an electron discharging plane of said cathode is disk-shaped and the diameter of the electron dischargeable region is less than 80% of the diameter of the area from where electrons are discharged when a practical maximum current is taken out without limiting the electron dischargeable region. For this reason, an electron gun can be provided which can improve the focusing characteristic of electron beams surely and effectively and prevent the drive circuit from being burdened to a certain degree.

In accordance with the fourth configuration of the present invention, in the first, second or third configuration, the surface of said electron dischargeable region has roughness within a range of 10 $\mu$m. For this reason, the effect due to the first, second or third configuration can be not only obtained, but also the focusing characteristic can be further improved.

What is claimed is:

1. An electron gun comprising:

a cathode for discharging electrons;

a plurality of grids each having electron passing-through holes for guiding the electrons discharged from the cathode unidirectionally; and an electron discharge region formed in an electron discharging plane of said cathode;

wherein said electron discharge region is constituted by a band-shaped area; and wherein the length of a shorter side of the band-shaped area constituting said electron discharge region is limited to be less than 80% of the length of an unlimited area from which electrons are discharged when a practical maximum current is taken out without limiting the electron discharge region.

2. An electron gun according to claim 1, wherein a surface of said electron discharge region has roughness less than approximately 10 $\mu$m.

3. An electron gun according to claim 1, wherein said unlimited area is disk-shaped, and the length of said unlimited area corresponds to the diameter of said unlimited area.

4. An electron gun comprising:

a cathode for discharging electrons;

a plurality of grids each having electron passing-through holes for guiding the electrons discharged from the cathode unidirectionally;

an electron discharge region formed in an electron discharging plane of said cathode;

wherein said electron discharge region is disk-shaped and is limited to have a diameter which is less than 80% of a diameter of an unlimited area from which electrons are discharged when a practical maximum current is taken out without limiting the electron discharge region.

5. An electron gun according to claim 4, wherein a surface of said electron discharge region has roughness less than approximately 10 $\mu$m.

6. An electron gun comprising:

a cathode for discharging electrons;

a plurality of grids each having electron passing-through holes for guiding the electrons discharged from the cathode unidirectionally; and an electron discharge region formed in an electron discharging plane of said cathode;

wherein said electron discharge region is band-shaped and a surface of said electron discharge region has roughness less than approximately 10 $\mu$m.

* * * * *